US010892546B2

(12) United States Patent
Silva

(10) Patent No.: US 10,892,546 B2
(45) Date of Patent: Jan. 12, 2021

(54) MOTOR-VEHICLE ANTENNA

(71) Applicant: Hirschmann Car Communication GmbH, Neckartenzlingen (DE)

(72) Inventor: David Silva, Neckartenzlingen (DE)

(73) Assignee: HIRSCHMANN CAR COMMUNICATION GMBH, Neckartenzlingen (DE)

( * ) Notice: Subject to any disclaimer, the term of this patent is extended or adjusted under 35 U.S.C. 154(b) by 0 days.

(21) Appl. No.: 16/094,159

(22) PCT Filed: May 11, 2017

(86) PCT No.: PCT/EP2017/061247
§ 371 (c)(1),
(2) Date: Oct. 16, 2018

(87) PCT Pub. No.: WO2017/194644
PCT Pub. Date: Nov. 16, 2017

(65) Prior Publication Data

US 2019/0140346 A1 May 9, 2019

(30) Foreign Application Priority Data

May 11, 2016 (DE) ..... 10 2016 208 130

(51) Int. Cl.

| | |
|---|---|
| ***H01Q 1/38*** | (2006.01) |
| ***H01Q 1/20*** | (2006.01) |
| ***H01Q 1/32*** | (2006.01) |
| ***H01Q 21/28*** | (2006.01) |

(52) U.S. Cl.
CPC ..... *H01Q 1/38* (2013.01); *H01Q 1/20* (2013.01); *H01Q 1/32* (2013.01); *H01Q 21/28* (2013.01)

(58) Field of Classification Search
CPC ..... H01Q 1/38; H01Q 21/28; H01Q 1/32; H01Q 1/20
See application file for complete search history.

(56) References Cited

U.S. PATENT DOCUMENTS

| | | | | |
|---|---|---|---|---|
| 6,351,242 | B1 | 2/2002 | Hesker | |
| 6,803,880 | B2 | 10/2004 | Spiropoulos | |
| 7,889,150 | B2 | 2/2011 | Gottwald et al. | |
| 9,236,655 | B2 | 1/2016 | Silva | |
| 2004/0075612 | A1* | 4/2004 | Spiropoulos | H01Q 1/38 343/702 |
| 2009/0015509 | A1* | 1/2009 | Gottwald | H01Q 1/3233 343/878 |

FOREIGN PATENT DOCUMENTS

| | | | |
|---|---|---|---|
| DE | 10200503063 | A1 | 1/2007 |
| DE | 102005030630 | B | 1/2007 |

* cited by examiner

*Primary Examiner* — Dimary S Lopez Cruz
*Assistant Examiner* — Michael M Bouizza
(74) *Attorney, Agent, or Firm* — Andrew Wilford

(57) ABSTRACT

Antenna arrangement (1) for a vehicle, comprising an antenna film (2) that has at least one electroconductive antenna structure, characterized in that the antenna film (2) is tautly arranged in a supporting frame (3) and is placed and secured at the mounting location of the antenna film (2) by means of the supporting frame (3).

5 Claims, 1 Drawing Sheet

MOTOR-VEHICLE ANTENNA

CROSS REFERENCE TO RELATED APPLICATIONS

This application is the US-national stage of PCT application PCT/EP2017/061247 filed 11 May 2017 and claiming the priority of German patent application 102016208130.6 itself filed 11 May 2016.

FIELD OF THE INVENTION

The invention relates to an motor-vehicle antenna having a film antenna having a film antenna with at least one electrically conductive antenna element

BACKGROUND OF THE INVENTION

DE 10 2013 201 755 [U.S. Pat. No. 9,236,655] discloses an antenna in which at least one electrically conductive antenna element for sending and/or receiving high frequency signals is provided on a film antenna. This antenna is installed in a vehicle, wherein the at least one antenna element, in particular its base point, is connected to a cable and the cable transmits by way of example the received high frequency signals to an electronic device for further processing. It is necessary in the case of this antenna that the film antenna is provided, in particular stamped out, in the desired geometry, that subsequently the at least one electrically conductive antenna element is applied and that subsequently this two-dimensional structure is not only handled (mounted) after its production but rather that it must also be provided and fixed at its installation site in the intended manner. When handling the prepared antenna, in practice reoccurring problems occur, in particular the film antenna and the antenna element provided thereon become damaged, the reason being that the two-dimensional structure is thin and delicate. The film antenna is generally fixedly adhered at its installation site, with the result that it is not possible or only possible with a great outlay to replace the film antenna if by way of example the antenna element becomes damaged.

OBJECT OF THE INVENTION

The object of the invention is to further improve a generic-type motor-vehicle antenna and to avoid the disadvantages mentioned in the introduction.

SUMMARY OF THE INVENTION

This object is attained in accordance with the invention in that the film antennae is mounted, in particular after its production and after applying the at least one electrically conductive antenna element, in a pretensioned manner in a support frame, wherein the film antenna is mounted and attached at its installation site by the support frame. The support frame is a separate component that is produced in addition to the film antenna and in particular matches the geometric dimensions of the film antenna. After the production of the support frame, which can be performed by way of example in a synthetic material injection molding procedure, and after the production of the film antenna, these two elements are connected to one another with the result that on the one hand the film antenna may be mounted and attached at its installation site by the support frame. As a result, damage to the film antenna and above all also damage to the often delicate antenna element during the assembly procedure and also after the assembly procedure are effectively avoided. Moreover, it is possible by virtue of fixing the antenna in a pretensioned manner in the support frame to provide the film antenna with the desired two-dimensional arrangement, in order on the one hand to avoid short circuits in the case of any distortions of the film antenna and on the other hand to achieve an optimum transmitting and/or receiving behavior using such an antenna.

In a further development of the invention, the support frame is formed as a grid. One possible design of the support frame is that it forms a circumferential outer frame within which the film antenna is mounted and attached in a pretensioned manner. In order to support the position of the film antenna in the support frame, the support frame is formed as a grid with the result that transverse and longitudinal webs are provided within the support frame and it is possible for the film antenna to lie against the webs and/or to be attached thereto. Depending upon the design of the grid shape of the support frame, the support frame has a planar two-dimensional construction with the result that the pretensioned film antenna is also mounted in a two-dimensional and planar manner. Alternatively thereto, it is also conceivable to provide the grid-shaped support frame with a three-dimensional design. This may be by way of example a bent shape, a crescent shape or the like. Such a three-dimensional support frame may preferably comprise such a geometric shape that matches the geometry at the intended installation site.

In a further development of the invention, the support frame has at least one outwardly projecting lug and the film antenna has at least one aperture that fits with the lug. The at least one lug that projects from the support frame fits with the aperture in the film antenna with the result that the film antenna may be effectively and permanently fixed to the support. It is particularly preferred that two or more than two lugs are provided on the frame. The lugs may be embodied by way of example as latching hooks. The film antenna has apertures according to the number of lugs on the support frame with the result that by virtue of this lug-aperture combination the film antenna may be fixed to the support frame in a very simple and simultaneously permanent manner. In a particularly advantageous manner, the lugs are configured in such a manner that they provide the pretensioning of the film antenna. In the case of a square-shaped or rectangular support frame, these lugs are located by way of example on the four corner regions, wherein where necessary further lugs may also be provided there between. The same also applies for a support frame that is not formed as a two-dimensional or planar manner but rather that has a three-dimensional shape. It is likewise possible but not necessary for the lugs to be provided in the corner regions but rather they may also be provided at any site in the progression of the boundary region of the support frame.

In a further development of the invention, the support frame has at least one attachment formation that attaches the support frame at its installation site. This attachment formation is produced together with the support frame and renders it possible to fix the support frame via corresponding attachment means at the installation site. As an alternative to such an attachment formation and the use of corresponding attachment means, it is also conceivable for the support frame to be fixed at its intended installation site in another manner (for example by a latched connection, a bonded connection or similarly-functioning connections).

Further embodiments in particular of the support frame in accordance with the invention are disclosed in the subordinate claims that describe relevant advantages.

BRIEF DESCRIPTION OF THE DRAWING

One exemplary embodiment of the antenna in accordance with the invention is described below and illustrated in the drawing in which.

SPECIFIC DESCRIPTION OF THE INVENTION

Figures 1, 2, 3:
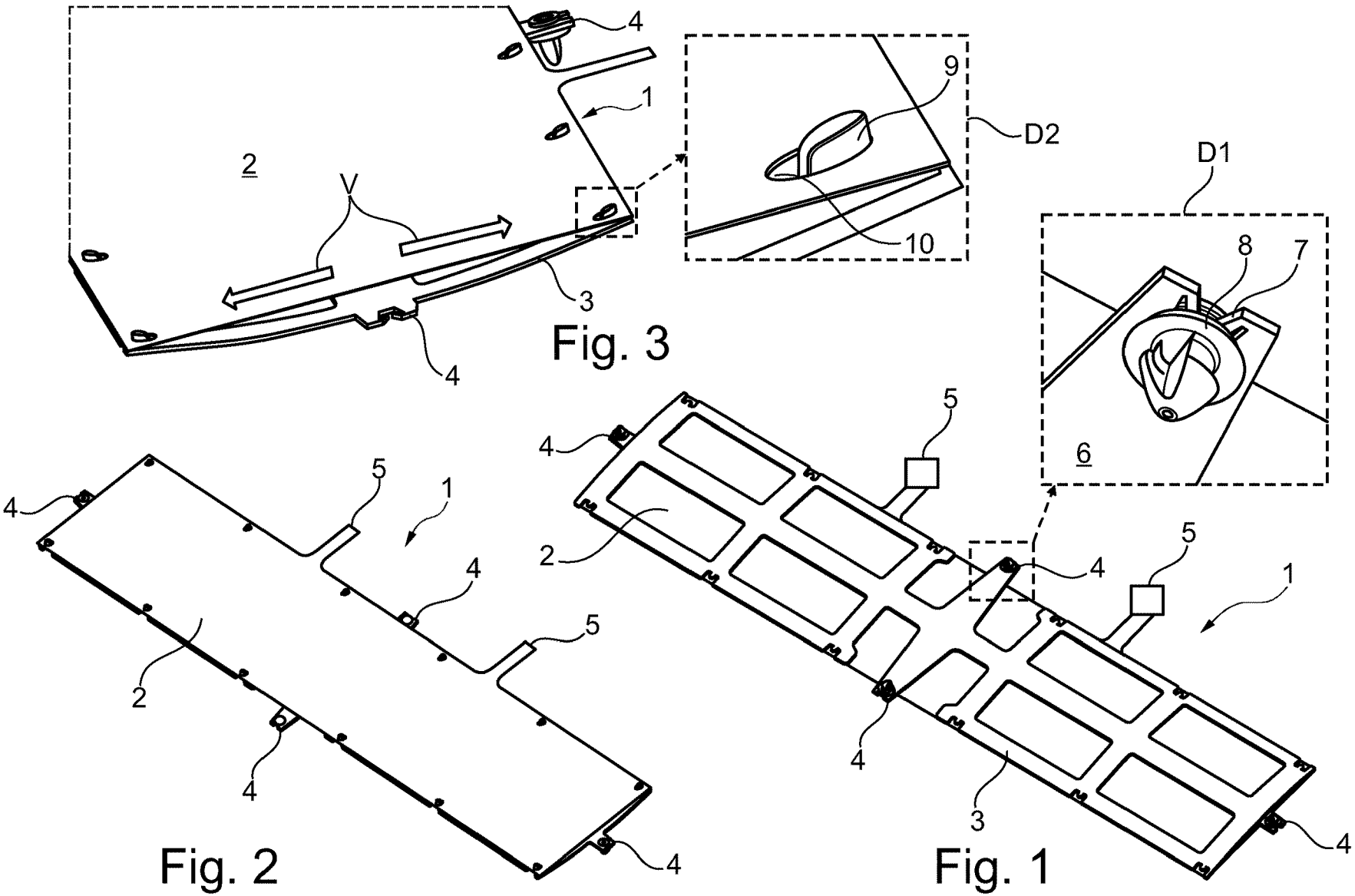
FIG. 1 is an isometric bottom view of the antenna of this invention.
FIG. 2 is an isometric top view of the antenna shown in FIG. 1.
FIG. 3 is a large-scale view of a detail of FIG. 2.

The numeral 1 describes an antenna in FIGS. 1 to 3 insofar as the details are illustrated. This antenna 1 has a film antenna 2 and an electrically conductive antenna element for transmitting and/or receiving high frequency signals is applied to or incorporated into the film antenna. According to the invention, a support frame 3 is provided on which the film antenna is mounted in a pretensioned manner. The support frame 3 in this exemplary embodiment is grid-shaped and has lugs that extend in parallel on its outer boundary regions, the lugs having recesses. The film antenna 2 may be supported on the support frame 3 in its outer region and, insofar as they are present, supported on the lugs in the inner region, in other words the film antenna lies against the lugs in these regions.

The support frame 3 is illustrated in FIGS. 1 and 2 with the pretensioned film antenna 2 one view from above and one view from below. It is apparent that at least one attachment formation 4 extends outwardly projecting from the support frame 3. Overall, in each case one attachment formation 4 is provided in the exemplary embodiment on each lateral edge of the support frame. The attachment formation 4 renders it possible to fix the support frame 3 in an optimal and intended manner at its installation site. However, it is also conceivable to arrange on one side of the support frame 3 more than one attachment formation 4 or also not to provide an attachment formation 4 on one side of the support frame 3.

A contact 5 that likewise projects outwards from the support 3 is provided for the purpose of contacting in an electrical manner the electrically conductive antenna element [not illustrated]. A plug connector, a cable or the like may be provided at this contact 5 and used to connect the antenna 1 to a down-stream electronic device. However, a contact 5 may also come into contact with a further corresponding contact by way of example with a contact on the electronic device.

Whereas FIGS. 1 and 2 illustrate that the attachment formations 4 and also the contacts 5 are in approximately the same plane in which the support frame 3 is also located, it is also conceivable that at least one attachment formation 4 and/or a contact 5 are not in this plane. By way of example, it is possible for at least one contact 5 to project in a somewhat perpendicular manner from the support frame 3 or also at a different angle.

With respect to FIG. 1, reference is made to detail D1. Detail D1 illustrates an exemplary design of the attachment formation 4. This attachment formation 4 is configured as a tab 6 that projects from the support frame 3 and has a cut-out 7 for receiving an expanding anchor pin 8. The cut-out 7 in the tab 8 is aligned with a corresponding receiving opening at the installation site and subsequently the expanding anchor pin 8 is inserted into this opening with the result that the support frame 3 may be fixed at the installation site by the at least one expanding anchor pin 8 by being simply pressed in. The design of the tab 6 with the cut-out 7 has the advantage that as a result of the pre-assembled arrangement the expanding anchor pin 8 may be fixed at the attachment formation 4 and for the final assembly of the antenna 1 it is only necessary for the expanding anchor pin to be moved into the opening by simply pushing it in at the installation site. Consequently, the respective expanding anchor pin 8 is directly available as an attachment means for fixing the support frame 3 at the installation site with the result that as a consequence the procedure of assembling the antenna 1 is fundamentally simplified in accordance with the invention.

It is apparent in FIG. 3 that the film antenna 2 is mounted in a pretensioned manner on the support 3. This pretensioned arrangement is by way of example, as is apparent in the detailed illustration D2, achieved by a lug 9 that projects from the support frame 3 and fits with an aperture 10 in the film antenna 2. The lugs 9 that are provided in the required number are provided at the time of producing the support frame 3 with the result that by way of example the support frame 3 together with the lugs 9 form a one-piece component that may be produced for example in a synthetic injection molding procedure. The corresponding apertures 10 may be stamped out in the film antenna 2 in a simple manner. If the elements involved are prepared accordingly, it is possible to fix the film antenna 2 to the support frame 3 in a pretensioned manner V by folding it over with its aperture 10 over the associated lug 9. For this purpose, the spacing of two adjacent lugs 9 is slightly less than the spacing of the associated apertures 10 with the result that it is necessary to slightly bend the support frame 3 so that it is possible to insert the lugs 9 into the associated apertures 10. In order to avoid the film antenna 2 from becoming detached, it is also possible to provide at the projecting end of each lug 9 a protrusion, an aperture or the like that prevents the film antenna 2 from becoming detached from the lug 9.

The geometry of the antenna 1 illustrated in FIGS. 1 to 3 is merely exemplary and may comprise other shapes than the rectangular elongated shape. Rounded, crescent-shaped, triangular, square-shaped and other geometric extensions of the support frame 3 are also conceivable. It is also not necessary to configure the support frame 3 in a two-dimensional manner (planar and two-dimensional) but rather it may also have a three-dimensional shape (such as for example an arched shape).

The invention claimed is:

1. A motor-vehicle antenna comprising:

a film antenna having at least one electrically conductive antenna element and having opposite edges each formed with a respective row of throughgoing apertures; and a support frame and having opposite edges each formed with a respective row of upstanding lugs arrayed like the apertures of the film antenna, the film antenna being mounted and attached at its installation site by engagement of the lugs through the apertures to pretension the film antenna between the rows of lugs on the support frame, a spacing between the rows of lugs being greater than a spacing between the rows of apertures to ensure pretensioning of the film antenna on the frame.

2. The antenna according to claim 1, wherein the support frame is formed as a grid.

3. The antenna according to claim 1, wherein the support frame has at least one attachment formation that attaches the support frame at its installation site.

4. The antenna according to claim 3, wherein the at least one attachment formation is configured as a tab that projects from the support frame and has a cut-out for receiving an expanding anchor pin.

5. The antenna according to claim 1, wherein the support frame has at least one contact.

* * * * *